US005935881A

United States Patent [19]

Abiru et al.

[11] Patent Number: 5,935,881

[45] Date of Patent: Aug. 10, 1999

[54] BULLETPROOF FABRIC AND PROCESS FOR ITS PRODUCTION

[75] Inventors: Shigeo Abiru, Osaka; Kenji Iizuka, Kyoto, both of Japan

[73] Assignee: Toyo Boseki Kabushiki Kaisha, Osaka-fu, Japan

[21] Appl. No.: 08/997,345

[22] Filed: Dec. 23, 1997

[30] Foreign Application Priority Data

Dec. 26, 1996 [JP] Japan ..... 8-349018

[51] Int. Cl.[6] ..... D01D 11/02

[52] U.S. Cl. ..... 442/97; 442/98; 442/100; 28/282; 427/389.9; 428/902

[58] Field of Search ..... 442/97, 98, 100; 28/282; 427/389.9; 428/902

[56] References Cited

U.S. PATENT DOCUMENTS 5,397,627 3/1995 Dunbar et al. ..... 428/229

*Primary Examiner*—Christopher Raimund

*Attorney, Agent, or Firm*—Morrison & Foerster LLP

[57] ABSTRACT

A bulletproof fabric that fully exhibits the mechanical properties of constituent filaments to have light weight and high bulletproof performance is provided. The bullet-proof fabric contains a non-twisted, non-interlaced multifilament having a total fineness of 10 to 1000 denier both as a warp and as a weft. The multifilament consists mainly of at least one high-strength, high-modulus filament having a single fiber fineness of 10 denier or less. For the bulletproof fabric, the value of $\alpha$ calculated by expression (1):

$$\alpha = N \cdot D/1000 \quad (1)$$

where N is the density in warp of fabric (yarns/inch) and D is the total fineness (d), is in the range of from 8.5 to 10.5, and the air permeability of the fabric satisfies expression (2):

$$P \leq \alpha^2/[7+D^{(1/2N)}] \quad (2)$$

where P is the air permeability (cc/cm$^2$/s) as defined in JIS L 1079 5-20. Also provided is a process for producing such a bulletproof fabric.

7 Claims, 2 Drawing Sheets

BULLETPROOF FABRIC AND PROCESS FOR ITS PRODUCTION

FIELD OF INVENTION

The present invention relates to a bulletproof fabric for protecting the body of a wearer against bullets or other small projectiles, and a process for its production. The bulletproof fabric of the present invention can be made as a single material into articles of bulletproof clothing and, if necessary, it can also be used in layers with other bulletproof materials such as fiber reinforced plastics (FRP).

BACKGROUND OF THE INVENTION

The bulletproof performance as an index for ascertaining the quality of a bulletproof fabric determines how light weight of the fabric is sufficient to prevent the penetration of bullets. It is well known that this performance greatly depends upon the tensile strength and initial tensile modulus of original fibers used. The term "tensile strength" as used herein refers to the quotient of the tensile tenacity of a material divided by the weight of the material.

As a matter of course, preferred bulletproof fabrics have higher bulletproof performance. Since bulletproof fabrics are continuously kept as an article of clothing on the body of a wearer for many hours, they should not lower the mobility of the wearer and they are further required to have light weight. When bulletproof fabrics are made into articles of clothing or other products, they are usually used in layers.

The conventional bulletproof fabrics known in the art include those made of aramid fibers (hereinafter referred to as conventional example 1). Aramid fibers are, however, not suitable for this purpose because of their insufficient tensile strength and initial tensile modulus. In addition, the wounding and killing power of small arms has remarkably increased in recent years. For these reasons, there has been a great demand for higher performance bulletproof fabrics as a countermeasure against these small arms.

This problem may be solved, for example, by increasing the number of layers of the bulletproof fabrics made of aramid fibers. In this case, however, it is attended with a significant increase in weight, and taking into consideration the fact that the bulletproof fabrics are used for the articles of clothing, it results in a fatal defect depending upon the level of weight increase.

By the way, since bulletproof fabrics are literally fabrics, warps and wefts are meandering or winding by their intersection. For example, when a warp intersects with a weft so as to pass under the weft, the warp intersects with the next wefts so as to pass over these next wefts. Thus, the warps and wefts are meandering through each other. It follows that each of the yarn-forming filaments is also undulating or winding.

FIG. 3A is an enlarged schematic view in part of undulating filament 10, showing that force is exerted to filament 10 in the direction of arrow A. In such undulating filament 10, the force exerted to the outer side of the undulating portion becomes unbalanced with and is greater than the force exerted to the inner side of the undulating portion.

FIG. 3B is an enlarged schematic view in part of liner filament 20, showing that force is exerted to filament 20 in the direction of arrow A. In such linear filament 20, the force is uniformly exerted all over the portions of each filament.

As can be seen from the comparison between FIGS. 3A and 3B, filament 10 given unbalanced force as shown in FIG. 3A can only resist weaker force as compared with filament 20 given well-balanced force as shown FIG. 3B, so that the tensile strength of the fabric is decreased. In the case of high-tenacity fibers such as particularly used for the bulletproof fabrics, their elongation at break is small and their knot tenacity is extremely lower than their linear tenacity (i.e., they have a small retention of tenacity). Therefore, when each filament of the high-tenacity fibers is undulating, their original high tenacity turns to an extremely lower one.

In order to ensure that the exertion of force does not become unbalanced and the mechanical properties of each filament, such as tensile strength, can therefore be exhibited to the full extent, it would be necessary to increase the linearity of the filament.

When twisted yarns are used in the bulletproof fabric, each of the filaments forming a yarn is made by the twist of the yam to undulate or wind in this yarn, for which same reason the mechanical properties of each filament cannot be fully exhibited. For example, the tenacity of a twisted yarn decreases several percent to several tens percent as compared with the linear tenacity of an original filament.

In addition, twisted yarns have a tendency to take a round section at a higher twist coefficient, so that the diameter of twisted yarns (i.e., yarn height in the direction of fabric thickness) increases as compared with flat yarns and the meandering of the twisted yarns becomes marked when they are made into a fabric.

The linearity of filaments may be retained by the use of non-twisted yarns. In the case where non-twisted yarns are used in the actual operation, however, there arises a serious problem that the breaking or fibrillation of yarn-forming filaments is liable to occur by the warps' own abrasion or contact in the weaving. From a viewpoint of avoiding such a problem and thereby improving the weaving efficiency, there is no other way in most cases but to use twisted yarns in the weaving under the existing circumstances.

For the weaving density of a fabric, the meandering of fabric-forming yarns becomes sharper at higher weaving density, so that yarn-forming filaments cause undulation. Therefore, the tensile strength of the filaments cannot be exhibited to such an extent as expected in theory, and it will be decreased in practical use.

Furthermore, in the case of a fabric with higher weaving density, mutual binding force at the points of intersection between the warps and the wefts becomes stronger, and when bullets or other small projectiles collide with the fabric, shock waves are reflected and accumulated in the form of stress at these points of intersection. If the mutual binding force at the points of intersection is weak, shock waves are transmitted through the fabric-forming fibers to cause a dispersion of energy over a wide area, so that the fabric can withstand the shock of the bullets or other small projectiles. The accumulation of stress derived from the shock waves as described above, however, causes breaking of the fabric.

If there is the meandering of yarns in a fabric, when bullets or other small projectiles hit the fabric, the fabric-forming yarns are first drawn by the bullets or other small projectiles to make their winding or meandering sharpened at a limited part, and the yarn-forming fibers are then drawn. In other words, the fibers are not drawn in the direction of their own axis until the winding becomes sharper at a limited part, and the fibers are given strong compressive force in a direction perpendicular to the fiber axis. Therefore, when the deformation of a bulletproof fabric caused by the invasion of a bullet is too slow to follow the speed of the bullet, the fabric-forming yarns only undergo compressive breaking and the kinetic energy of the bullet is not effectively converted into another energy necessary for the fiber breaking, so that the fabric is readily perforated.

The linearity of filaments may be improved by decreasing the weaving density to temper the meandering of yarns. In this case, however, when a fabric catches bullets or other small projectiles, the weave pattern of the fabric deviates from its original pattern, so that the fabric is readily perforated to form holes and the bullets or other small projectiles can pass though these holes. Therefore, bulletproof fabrics should be produced with increased weaving density, so that the mechanical properties of filaments cannot be fully exhibited.

As the material fiber, there have been proposed ultrahigh molecular weight polyethylene fibers (hereinafter sometimes referred to UHMW-PE fibers) having specific strength and specific modulus both exceeding those of aramid fibers. UD fiber-layered sheets made of UHMW-PE fibers and binder resins (generally called "shield materials"; conventional example 2.1), and fabrics made of UHMW-PE fibers (conventional example 2.2) have begun to be put to practical use.

However, conventional example 2.1, although it is effective against a certain kind of special ball cartridges, is not suitable to cope with the threats of relatively low level, such as shrapnels (i.e., shell fragments). In addition, it requires a binder resin having no direct relation to the energy absorption, and such a resin is contained to the amount of 30 wt % or higher, resulting in a defect that the fabric becomes too heavy.

In the case of conventional example 2.2, as described above, the mechanical properties of filaments (i.e., UHMW-PE fibers) cannot be fully utilized because each filament in the fabric is undulating. As a result, the bulletproof performance of the fabric cannot be exhibited to an extent as expected.

JP-A 8-502555/1996 discloses a bulletproof fabric proposed in an attempt to solve the above problem by giving a twist to the filaments (hereinafter referred to as conventional example 3). Conventional example 3 is a bulletproof fabric comprising a multifilament yam made of high-strength filaments each having a tenacity of about 7 g/d or more and a tensile modulus of about 150 g/d or more, and each requiring an energy for breaking of about 8 J/d or more. The multifilament yarn has a portion in which the filaments are entangled with each other and a portion in which the filaments are arranged substantially in parallel to the lengthwise direction. In the portion of filaments arranged in parallel, the mechanical properties of filaments can be exhibited to absorb impact energy and the flatness of these filaments can give a close weave, thereby making an attempt to improve the bulletproofness. In the portion of entangled filaments, they are bound with each other to prevent the breaking or fibrillation of filaments at the time of weaving, thereby making an attempt to prevent a deterioration in weaving efficiency.

However, conventional example 3 can only exhibit the mechanical properties of filaments on a low level in the portion of entangled filaments because of their non-linearity. The presence of such a weak portion, even if in part, is responsible for the initial breaking of filaments in the weak portion when external force is exerted thereto, so that the overall strength of the fabric is lowered. Therefore, even in the conventional example 3, the mechanical properties of filaments are not yet fully utilized.

SUMMARY OF THE INVENTION

Under these circumstances, the present inventors have intensively studied to develop a bulletproof fabric that can fully exhibits the mechanical properties of constituent filaments to have light weight and high bulletproof performance against a wide range of threats ranging from the threats of high level to the threats of relatively low level, thereby completing the present invention.

Thus, the present invention provides a bulletproof fabric comprising a non-twisted, non-interlaced multifilament having a total fineness of 10 to 1000 denier both as a warp and as a weft, the multifilament consisting mainly of a high-strength, high-modulus filament having a single fiber fineness of 10 denier or less, wherein the value of $\alpha$ calculated by expression (1):

$$\alpha = N \cdot D/1000 \quad (1)$$

where N is the density in warp of fabric (yarns/inch) and D is the total fineness (d), is in the range of from 8.5 to 10.5, and the air permeability of the fabric satisfies expression (2):

$$P \leqq \alpha^2/[7+D^{(1/2N)}] \quad (2)$$

where P is the air permeability (cc/cm$^2$ /s) as defined in JIS L 1079 5-20.

The present invention further provides a process for producing a bulletproof fabric as described above, which comprises preparing a non-twisted, non-interlaced multifilament by opening original filaments so that a bundle of the filaments has a flat section; applying a fabric size to the multifilament, followed by drying; and weaving the sized multifilament as a warp or both as a warp and as a weft into the fabric.

DETAILED DESCRIPTION OF THE INVENTION

In the context of the following, the terms "filament" and "fiber" are sometimes interchangeable, and the terms "multifilament" and "yarn" are sometimes interchangeable.

As far as fabrics are concerned, the meandering of warps and wefts is inevitably caused by their intersection. If the weaving density of a fabric is decreased for the purpose of reducing the meandering of warps and wefts to a minimum, the weave pattern is liable to deviate from its original pattern as described above, so that the fabric has deteriorated bulletproof performance. An increase in the weaving density is harmful to the linearity of yarn-forming filaments, so that the bulletproof performance is also deteriorated. In the present invention, such conflicting conditions are adjusted so that the bulletproof performance of the fabric can be exhibited to the full extent.

The present inventors have produced various fabrics from multifilaments of different finenesses with different values of weaving density, and measured these fabrics for bulletproofness [V50FSP]. The results are shown in Table 1. V50FSP is one of the indices used for the evaluation of bulletproofness, and it was obtained by measuring the speed (m/s) of a bullet at which the bullet can be stopped at 50% probability, and calculating the impact energy (J·m$^2$/kg) that can be absorbed by the bulletproof fabric from the bullet speed according to the expressions (3) and (4). The bulletproofness [V50FSP] was determined by the use of bullets (diameter, 5.5 mm; weight, 1.1 g) as defined in MIL-P-46593A (ORD) according to the procedure as defined in MILSTD662E.

$$F_0=(1/2)\cdot M\cdot V^2 \quad (3)$$

where $F_0$ is the impact energy (J) of a bullet, M is the weight (g) of the bullet, and V is the speed (m/s) of the bullet;

$$F=F_0/A \quad (4)$$

where F is the impact energy ($J\cdot m^2/kg$) and A is the basis weight ($g/m^2$) of a sample (e.g., fabric, layered product).

The values of α calculated by expression (1) and the values of air permeability measured on the above fabrics are also shown in Table 1.

TABLE 1

| Total fineness (d) | Density in warp (yarns/inch) | α | Bulletproofness [V50FSP] ($J\cdot m^2/kg$) | Air permeability ($cc/mm^2/s$) |
|---|---|---|---|---|
| 100 | 80 | 8.0 | 30.1 | 34.0 |
| | 85 | 8.5 | 41.6 | 11.3 |
| | 92 | 9.2 | 42.9 | 6.1 |
| | 105 | 10.5 | 37.7 | 16.8 |
| | 110 | 11.0 | 27.0 | 46.2 |
| 200 | 40 | 8.0 | 29.1 | 38.5 |
| | 43 | 8.5 | 41.3 | 11.4 |
| | 46 | 9.2 | 42.9 | 6.2 |
| | 53 | 10.5 | 37.7 | 16.8 |
| | 55 | 11.0 | 26.0 | 51.5 |
| 400 | 20 | 8.0 | 26.1 | 45.7 |
| | 21 | 8.5 | 41.3 | 11.5 |
| | 23 | 9.2 | 39.9 | 6.2 |
| | 26 | 10.5 | 34.7 | 16.9 |
| | 28 | 11.0 | 23.0 | 60.0 |

Figure 1:
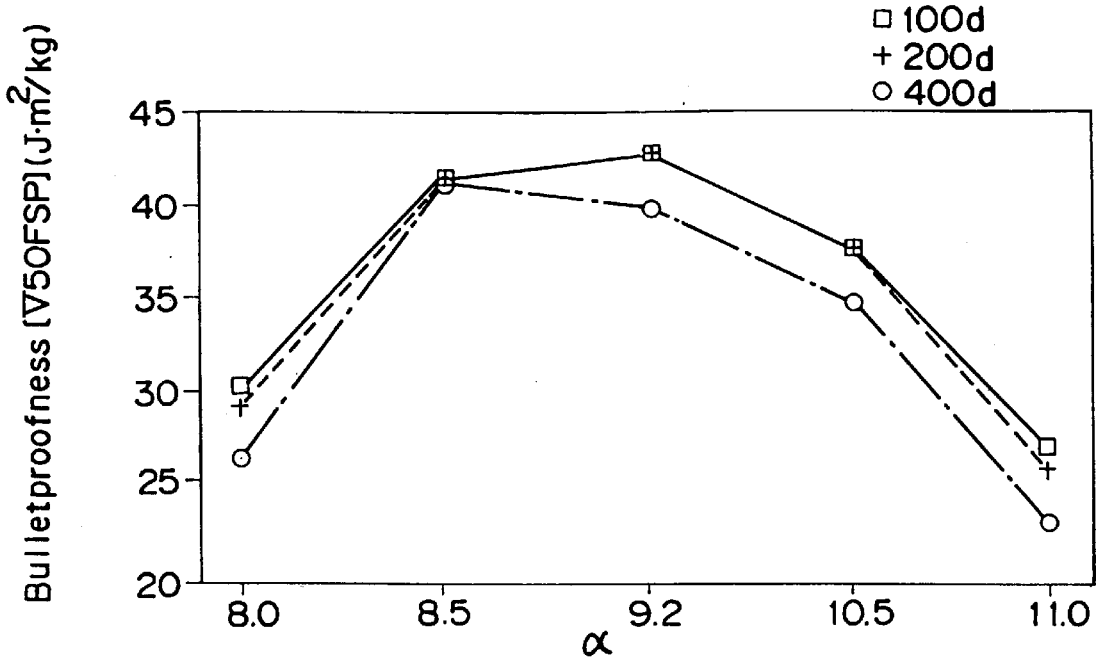
FIG. 1 is a graph showing the relationships between the values of $\alpha$ and the bulletproofness.
Figure 2:
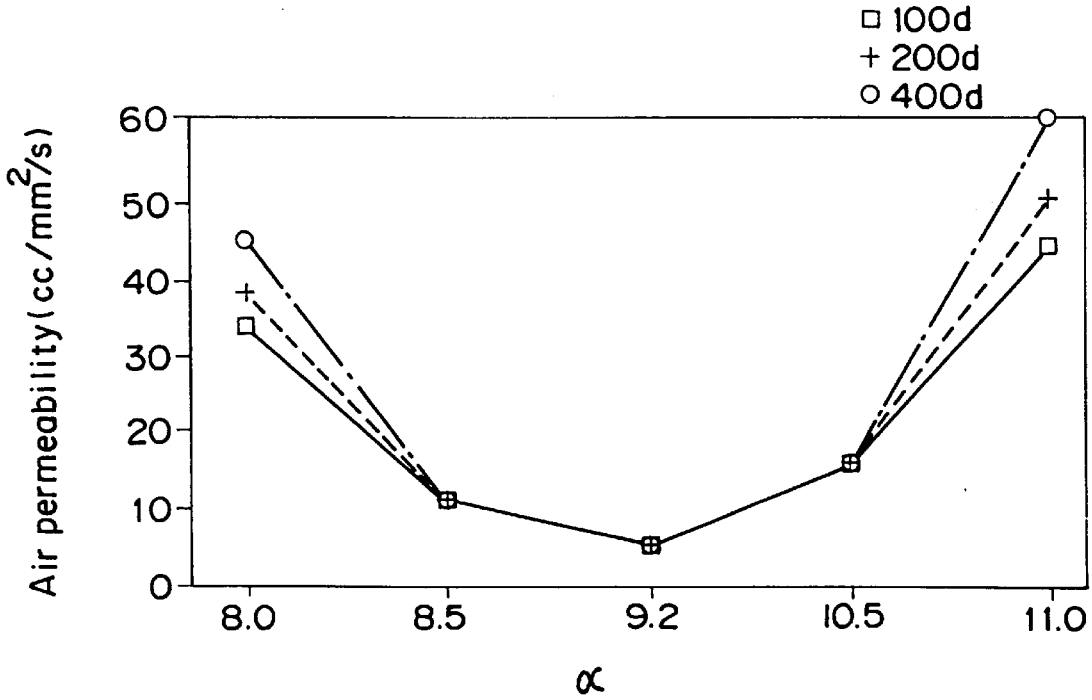
FIG. 2 is a graph showing the relationships between the values of $\alpha$ and the air permeability.
Figure 3A:
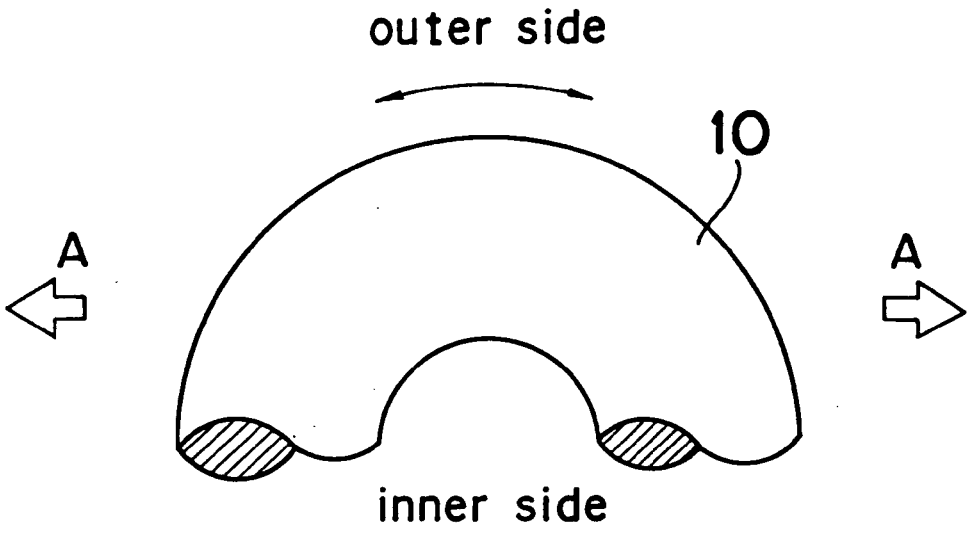
FIG. 3A is an enlarged schematic view in part of an undulating filament.
Figure 3B:
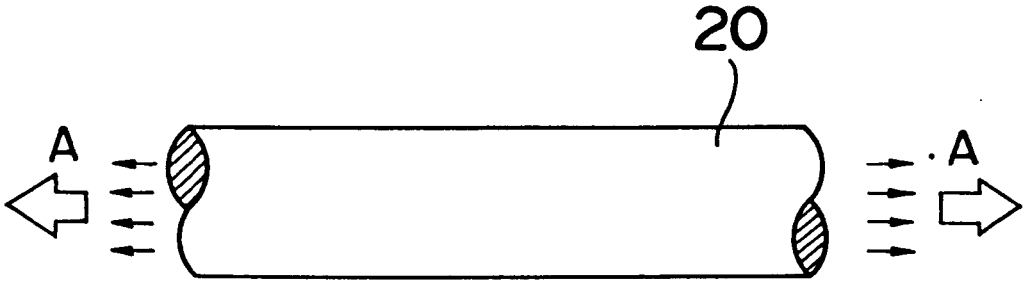
FIG. 3B is an enlarged schematic view in part of a linear filament.

FIG. 1 is a graph showing the results of Table 1 on the relationships between the values of α and the bulletproofness [V50FSP]. FIG. 2 is a graph showing the results of Table 1 on the relationships between the values of α and the air permeability.

As can be seen from Table 1 and FIG. 1, the fabrics each having a value of α in the range of from 8.5 to 10.5 exhibit higher bulletproofness. When the value of α is smaller than 8.5, the fabric have excellent fiber linearity; however, they have unstable shapes because of wider intervals between the weaving yarns, so that the fabric is liable to lose its shape at the time of sowing operation or wearing, resulting in an article exhibiting uneven performance along the fabric plane. Therefore, the fabric becomes weak in some parts, so that the bulletproofness of the fabric may vary from part to part, resulting in decreased reliability and deteriorated bulletproofness. When the value of α exceeds 10.5, the fabric retains a stable shape; however, the fiber linearity of warps and wefts is remarkably decreased by their intersection, so that the desired bulletproof performance cannot be obtained for the above-described reason.

Even if fabrics have the same weaving density and the same total fineness of yarns, the amplitude of meandering caused by the intersection of warps and wefts becomes smaller when flat yarns are used, in which case each filament in the yarn has high linearity to give excellent bulletproof performance of the resulting fabric.

The flatness of yarns can be expressed by the air permeability of a fabric. The air permeability is influenced both by the size of gaps between the yarns when the fabric is viewed from the direction of a normal thereof (hereinafter sometimes referred to as the plane gaps) and by the size of gaps in the thickness of yarns formed by the overlap of warps and wefts (hereinafter sometimes referred to as the thickness gaps). In the case of fabrics having the same weaving density and the same total fineness of yarns, the use of flat yarns makes both the plane gaps and the thickness gaps narrow, resulting in a fabric with decreased air permeability. The use of flat yarns also gives the small amplitude of meandering caused by the intersection of warps and wefts, which makes the yarns close to straight lines. Therefore, in the case of fabrics having the same weaving density and the same total fineness of yarns, the air permeability can be considered as an index not only of the flatness of yarns but also of the linearity of filaments.

In theory, the flattest yarn is formed from filaments arranged sidewise one by one, in which case the number of filaments necessary to produce a fabric with an area of 1 $m^2$ is calculated by expression (5):

$$f=(1000\times 2)/\phi \quad (5)$$

where f is the number of filaments (filaments/$m^2$) and φ is the diameter of filaments (mm).

In practice, however, the opening of yarns in such a manner is attended with some technical difficulty. That is, the preparation of flatter yarns is limited, and the use of filaments to the number of a theoretical value calculated by expression (5) gives the remaining plane gaps, resulting in a fabric with increased air permeability. Therefore, in actual cases, filaments are used to the number of a value several times to tens of times as large as the above theoretical value.

The present inventors have intensively studied on the theme that air permeability is reduced to the limit. As a result of development works and further investigation, they have found that if air permeability is adjusted to satisfy expression (2), fabrics for practical use can be produced without inconvenience in the actual weaving step or without lowering of productivity. The air permeability satisfying expression (2) gives not only good flatness of yarns but also good linearity of filaments, so that the mechanical properties of the filaments can be fully exhibited.

As can be seen from FIG. 2, when α<8.5, higher air permeability is obtained, which is because the fabric has wider plane gaps, and when α>10.5, air permeability also becomes higher, which is because the fabric has wider thickness gaps by a close texture. For the values of α around 9.2, air permeability takes small values, indicating that yams are made flat to give narrower plane gaps and narrower thickness gaps. Comparison of FIGS. 1 and 2 reveals that there is a correlation between the air permeability and the bulletproof performance. From this fact, it can also be supposed that the linearity of filaments has an influence on the bulletproof performance.

The multifilament to be used both as a warp and as a weft should be some non-twisted, non-interlaced one. This makes it possible to give a yam with high linearity of filaments having no undulation.

In addition, the single fiber fineness of each filament should be 10 denier or less. The use of thinner filaments gives an increased knot strength of yarns. When the single fiber fineness exceeds 10 denier, the bending strength of yarns becomes too small. The use of thinner filaments is also preferred for the small amplitude of meandering at the points of intersection between the warps and the wefts. For these reasons, the single fiber fineness of each filament is adjusted to be 10 denier or less.

The total fineness of a multifilament should be in the range of from 10 to 1000 denier. When the total fineness is less than 10 denier, the control of tension is difficult in the weaving. When the total fineness exceeds 1000 denier, the opening of yarns is attended with difficulty.

The whole or some part of the multifilament should be composed of a high-strength, high-modulus filament. When the multifilament contains no high-strength, high modulus filament, the use of filaments having low strength only gives a fabric with deteriorated bulletproof performance, even if the mechanical properties of the filaments can be fully exhibited.

The bulletproofness is based on the following mechanism. The kinetic energy of bullets or other small projectiles is effectively converted into another energy necessary for the breaking of fibers in a fabric, so that the energy of the bullets or other small projectiles is absorbed in the fabric to prevent their penetration. Therefore, if the mechanical properties (e.g., tensile strength, initial tensile modulus) of fibers are at higher level with good balance, the fabric made of these fibers can absorb higher energy. For this reason, the use of a high-strength, high-modulus filament is essential to the production of a higher performance bulletproof fabric as described above.

Furthermore, the multifilament to be used as a warp should have substantially the same properties as those of the multifilament to be used as a weft. If there is a difference in strength between the warps and the wefts, weaker yams first break when a shock is given, so that the bulletproofness of a fabric is dominated by the bulletproof performance of the weaker yarns and the strength of stronger yarns is not utilized.

In the bulletproof fabric of the present invention, the multifilament preferably contains a fiber having a tensile strength of 20 g/d or more, an elongation at break of 6% or less, and an initial tensile modulus of 400 g/d or more. The use of such a multifilament makes it possible to give a fabric with more excellent bulletproofness.

In the production process for the bulletproof fabric of the present invention, a non-twisted, non-interlaced multifilament is prepared by opening original filaments so that a bundle of the filaments has a flat section, a fabric size is then applied to the multifilament, followed by drying, and the sized multifilament is woven as a warp or both as a warp and as a weft into the fabric.

As described above, the use of a flat multifilament for weaving a fabric is preferred. In this case, the application of a fabric size to the multifilament prior to the weaving makes it possible to prevent the breaking or fibrillation of filaments at the time of weaving, thereby improving the weaving efficiency.

In the production process of the present invention, the above fabric size is preferably applied in an amount of 4 wt % or more to the multifilament. When the amount of fabric size applied is less than 4 wt %, the weaving efficiency cannot be improved so much.

After the weaving, 60 wt % or more of the applied fabric size is more preferably scoured from the fabric. This is because the scouring of the fabric size makes it possible to reduce the weight of the fabric. In the case where the sized multifilaments are used only as warps, there occurs a difference in apparent fineness between the warps and the wefts, resulting in a failure to keep the balance of linearity between the warps and the wefts. If the balance is lost in such a manner, the mechanical properties of a fabric is unbalanced between in the warp direction and in the weft direction. In other words, there is the possibility that the mechanical properties of fibers cannot be effectively utilized in the fabric. Therefore, the above scouring treatment for removing the fabric size is preferred.

After the scouring, the fabric is preferably subjected to calendar press treatment so that the fabric-forming yarns have increased linearity. The calendar press treatment is carried out by passing the fabric at any speed through two rollers (e.g., mirror polished rollers) kept in close contact with any pressure. This treatment makes it possible to further reduce the air permeability of the fabric, resulting in an improvement of the bulletproof performance.

In addition, after the scouring, the fabric is preferably coated with an agent for reducing frictional resistance (hereinafter sometimes referred to as the friction-lowering agent). The coating with such a friction-lowering agent makes it possible to reduce not only the frictional resistance at the points of intersection between the warps and the wefts but also the mutual frictional resistance of yarn-forming filaments, thereby allowing the fabric to express more excellent deformation-following properties. If a fabric has poor deformation-following properties, there is no time that the fibers of the fabric can absorb a shock caused by the invasion of bullets or other small projectiles, resulting in a breaking of the fabric, which allows the bullets or other small projectiles to go through the fabric. If the fabric has excellent deformation-following properties, the fabric can cause deformation to absorb such a shock.

The filament used in the bulletproof fabric of the present invention has high strength and high modulus as described above. The preferred filament has a tensile strength of 20 g/d or more, an elongation at break of 6% or less, and an initial modulus of 400 g/d or more. Examples of such a filament may include ultrahigh molecular weight polyethylene (UHMW-PE) fibers, aramid fibers, and polyarylate fibers. These fibers preferably have a weight average molecular weight of 500,000 or higher. The tensile strength is more preferably 37 g/d or more, the elongation at break is more preferably 5% or less, and the initial tensile modulus is more preferably 650 g/d or more, still more preferably 1400 g/d or more, and further still more preferably 1500 g/d or more. The bulletproof fabric of the present invention may contain any other filament than the above high-strength, high-modulus filament.

The filament has a single fiber fineness of 10 denier or less as described above, and the multifilament as a bundle of these filaments has a total fineness of 10 to 1000 denier and is some non-twisted, non-interlaced one.

In the production of a fabric, filaments as described above in arbitrary number are set in a creel stand (preferably without weft stop motion). These original fibers are warped all together, while undergoing a mechanical opening by rollers or bar guides, and then given a fabric size in an amount of 4.0 wt % or more, relative to the resulting yarn.

The fabric size may contain a polyacrylate ester or polyvinyl alcohol as the main ingredient. The fabric size is usually adjusted to a concentration of from 10.0 to 30.0 wt % and to a temperature of from 30° to 50° C. After the application of the fabric size, the yarns are dried by warm air and then wound up on a warper. The yarns wound up on the warper are further wound up on a beam to give the number of warps necessary for the weaving width.

The wefts may be non-sized yarns, i.e., yarns to which a fabric size has not been applied. The wefts, together with the warps on the beam, are woven with a loom such as a water jet loom, an air jet loom or a rapier loom in such a manner that the weaving density satisfies expression (1) and (2), resulting in a bulletproof fabric.

Among the above looms, a water jet loom is particularly preferred because the bundling of wefts in their beating is not spoiled so much. When thin filaments are used in large number as in the present invention and they are further made of fibers with low bundling efficiency such as UHMW-PE fibers, the use of a water jet loom is most preferred.

The wefts may also be coated with a fabric size in the same manner as the case of the warps and then dried by warm air to give sized yarns.

The weave of the fabric, although it is not particularly limited, may be suitably selected depending upon the application conditions of the fabric in the end use. Most preferred is a plain weave. In the case of a fabric with a plain weave, strong binding force is mutually exerted between the warps and the wefts, so that the weave form during use is kept in a relatively stable state.

The above fabric may be scoured and then dried, which makes it possible to lighten the basis weight of the fabric.

The scouring may be carried out with an aqueous solution containing a surfactant as the main ingredient. In the scouring and drying, the fabric size is preferably removed in an amount of 60 wt % or more, preferably 95 wt % or more, so that the weight of the fabric is reduced to a certain extent. In this case, the air permeability in expression (2) is of the fabric after the scouring and drying.

The fabric after the scouring and drying may further be subjected to calendar press treatment. In the calendar press treatment, the pressure applied to the rollers and the passing speed of the fabric are adjusted so that the fabric-forming yarns are neither damaged by compressive breaking nor attended with form damage such as weave deviation.

The above fabric may be treated with a friction-lowering agent. The friction-lowering agent may include, but is not particularly limited to, paraffin wax, Teflon type treatment agents, and fluorocarbon type treatment agents. The friction-lowering agent may be suitably selected depending upon the objective threats (i.e., small projectiles such as bullets, shrapnels, and their fragments), fiber materials used, fabric design, and other factors.

The present invention will be further illustrated by the following examples and comparative examples; however, the present invention is not limited to these examples.

EXAMPLES

Under the production conditions as shown in Tables 2 and 3, bulletproof fabrics of Examples 1 to 4 and Comparative Examples 1 to 5 were prepared by weaving, scouring, drying, and post-treatment. In addition, as Comparative Example 6, a shield material of conventional example 2-1 (i.e., UD fiber-layered sheet made of an UHMW-PE fiber and a binder resin) was prepared.

TABLE 2

| | | Example 1 | Example 2 | Example 3 | Example 4 |
|---|---|---|---|---|---|
| Original yarn used | Material fiber | UHMW-PE fiber | UHMW-PE fiber | UHMW-PE fiber | UHMW-PE fiber |
| | Total fineness | trade name: Dyneema ® (Toyo Boseki) | trade name: Dyneema ® (Toyo Boseki) | trade name: Dyneema ® (Toyo Boseki) | trade name: Dyneema ® (Toyo Boseki) |
| | Single fiber fineness | 200 d–192 f 1 d/f | 200 d–192 f 1 d/f | 200 d–192 f 1 d/f | 200 d–192 f 1 d/f |
| | Tensile strength | 41 g/d | 41 g/d | 41 g/d | 41 g/d |
| | Elongation at break | 4.0% | 4.0% | 4.0% | 4.0% |
| | Initial tensile modulus | 1450 g/d | 1450 g/d | 1450 g/d | 1450 g/d |
| Weaving denity | Warps | 46 yarns/inch | 46 yarns/inch | 46 yarns/inch | 46 yarns/inch |
| | Wefts | 46 yarns/inch | 46 yarns/inch | 46 yarns/inch | 46 yarns/inch |
| Weaving width | | 1000 mm | 1000 mm | 1000 mm | 1000 mm |
| Weave | | non-twisted plain weave | non-twisted plain weave | non-twisted plain weave | non-twisted plain weave |
| | Warps | 4.0 wt% sized | 4.0 wt% sized | 4.0 wt% sized | 4.0 wt% sized |
| | Wefts | non-sized | non-sized | non-sized | non-sized |
| Scouring | Bath ratio | 10:1 | 10:1 | 10:1 | 10:1 |
| | Treatment bath | surfactant | surfactant | surfactant | surfactant |
| | Temperature | 70° C. | 70° C. | 70° C. | 70° C. |
| | Treatment time | 60 minutes | 60 minutes | 60 minutes | 60 minutes |
| | Means | jigger or continuous scouring machine (open soaper) | jigger or continuous scouring machine (open soaper) | jigger or continuous scouring machine (open soaper) | jigger or continuous scouring machine (open soaper) |
| Drying | Temperature | 70° C. | 70° C. | 70° C. | 70° C. |
| | Treatment time | 20 minutes | 20 minutes | 20 minutes | 20 minutes |
| Amount of fabric size adhering after scouring and drying | | 2.2 wt % | 2.2 wt % | 2.2 wt % | 2.2 wt % |
| Post-treatment | | — | calender press | calender press friction-lowering agent 1.5 wt % applied | — |

TABLE 3

| | | Comparative Example 1 | Comparative Example 2 | Comparative Example 3 | Comparative Example 4 | Comparative Example 5 |
|---|---|---|---|---|---|---|
| Original yarn used | Material fiber | UHMW-PE fiber | UHMW-PE fiber | UHMW-PE fiber | UHMW-PE fiber | UHMW-PE fiber |
| | Total fineness | trade name: Dyneema ® | trade name: Dyneema ® | trade name: Dyneema ® | trade name: | trade name: |
| | Single fiber fineness | (Toyo | (Toyo | (Toyo | Dyneema ® | Dyneema ® |
| | Tensile Strength | Boseki) | Boseki) | Boseki) | (Toyo Boseki) | (Toyo Boseki) |
| | Elongation at break | 200d–90f | 200d–192f | 200d–192f | 200d–19f | 400d–390f |
| | Initial tensile modulus | 2 d/f | 1 d/f | 1 d/f | 10.5 d/f | 1 d/f |
| | Number of twists | 19 g/d | 41 g/d | 41 g/d | 41 g/d | 30 g/d |
| | | 6.0% | 4.0% | 4.0% | 4.0% | 4.0% |
| | | 630 g/d | 1450 g/d | 1450 g/d | 1450 g/d | 1000 g/d |
| | | (non-twisted) | (non-twisted) | (non-twisted) | (non-twisted) | S 100 T/m |
| Weaving density | Warps | 46 yarns/inch | 40 yarns/inch | 54 yarns/inch | 46 yarns/inch | 46 yarns/inch |
| | Wefts | 46 yarns/inch | 40 yarns/inch | 54 yarns/inch | 46 yarns/inch | 46 yarns/inch |
| | Weaving width | 1000 mm | 1000 mm | 1000 mm | 1000 mm | 1000 mm |
| Weave | | non-twisted plain weave | non-twisted plain weave | non-twisted plain weave | non-twisted plain weave | twisted plain weave (100 times/m twisting in the S direction) |
| Scouring | Warps | 4.0 wt % sized | 4.0 wt % sized | 4.0 wt % sized | 4.0 wt % sized | non-sized |
| | Wefts | non-sized | non-sized | non-sized | non-sized | non-sized |
| | Bath ratio | 10:1 | 10:1 | 10:1 | 10:1 | (no scouring) |
| | Treatment bath | surfactant | surfactant | surfactant | surfactant | |
| | Temperature | 70° C. | 70° C. | 70° C. | 70° C. | |
| | Treatment time | 60 minutes | 60 minutes | 60 minutes | 60 minutes | |
| | Means | jigger or continuous scouring machine (open soaper) | jigger or continuous scouring machine (open soaper) | jigger or continuous scouring machine (open soaper) | jigger or scouring machine scouring machine (open soaper) | continuous |
| Drying | Temperature | 70° C. | 70° C. | 70° C. | 70° C. | (no drying) |
| | Treatment time | 20 minutes | 20 minutes | 20 fliinutes | 20 minutes | |
| Amount of fabric size adhering after scouring and drying | | 3.2 wt % | 1.2 wt % | 2.7 wt % | 1.1 wt % | — |

The value of α, condition of expression (2), and air permeability for each of the bulletproof fabrics of Examples 1 to 4 and Comparative Example 1 to 6 are shown in Tables 4 and 5.

TABLE 4

| | | Example 1 | Example 2 | Example 3 | Example 4 |
|---|---|---|---|---|---|
| Total fineness (denier) | | 200 | 200 | 200 | 200 |
| Weaving density (yarns/inch) | | 46 | 46 | 46 | 46 |
| α | | 9.20 | 9.20 | 9.20 | 9.20 |
| Air permeability condition by expression (2) | | 8.96–13.68 | 8.96–13.68 | 8.96–13.68 | 8.96–13.68 |
| Air permeability ($cc/cm^2/s$) | Found | 10.50 | 10.50 | 10.50 | 10.50 |
| | Calculated | 10.50 | 10.50 | 10.50 | 10.50 |
| Condition of expression (2) | | satisfied | satisfied | satisfied | satisfied |

TABLE 5

| | Comparative Example 1 | Comparative Example 2 | Comparative Example 3 | Comparative Example 4 | Comparative Example 4 |
|---|---|---|---|---|---|
| Total fineness (denier) | 200 | 200 | 200 | 200 | 400 |
| Weaving density (yarns/inch) | 46 | 40 | 54 | 46 | 46 |
| α | 9.20 | 8.00 | 10.80 | 9.20 | 18.40 |

TABLE 5-continued

| | | Comparative Example 1 | Comparative Example 2 | Comparative Example 3 | Comparative Example 4 | Comparative Example 4 |
|---|---|---|---|---|---|---|
| Air permeability condition by expression (2) | | 8.96–13.68 | 8.95–13.66 | 8.97–13.70 | 8.96–13.68 | 8.96–1 3.67 |
| Air permeability ($cc/cm^2/s$) | Found | 9.10 | 20.00 | 16.20 | 10.50 | 0.40 |
| | Calculated | 10.50 | 7.93 | 14.49 | 10.50 | 41.97 |
| Condition of expression (2) | | satisfied | unsatisfied | unsatisfied | satisfied | unsatisfied |

The bulletproof fabrics of Examples 1 to 4 and Comparative Examples 1 to 6 were examined for basis weight, air permeability, tensile tenacity, and bulletproofness. Furthermore, layered products of each bulletproof fabric were examined for basis weight and bulletproofness. The layered products were as follows: No. 1, 40 layers of each bulletproof fabric; No. 2, 40 layers of each bulletproof fabric plus 40 layers of a shield material; No. 3, 40 layers of each bulletproof fabric; No. 4, 27 layers of each bulletproof fabric plus 40 layer of a shield material; and No. 5, 68 layers of a shield material. The shield material to be layered on each bulletproof fabric was the same as that of Comparative Example 6 (i.e., conventional example 2-1).

The results are shown in Tables 6 and 7.

The measurements of basis weight, air permeability, and tensile tenacity were carried out by the procedures as defined in JIS L 1096 6.4, JIS L 1096 6.27, and JIS L 1096 6.12, respectively. The bulletproofness was determined on V50FSP by the use of bullets (diameter, 5.5 mm; weight, 1.1. g) as defined in MIL-P-46593A (ORD) according to the procedure as defined in MILSTD662E. The bullet penetrability was determined by the use of bullets (diameter, 7.62 mm; weight, 80 g) with a gun "Tokkarev" as defined in NIJ 01010 0.3 at an average bullet speed of 530 m/s.

TABLE 6

| | | | | Example 1 | Example 2 | Example 3 | Example 4 |
|---|---|---|---|---|---|---|---|
| Characteristics of fabrics | | Basis weight ($g/m^2$) | | 84.0 | 82.5 | 83.7 | 84.0 |
| | | Air permeability ($cc/cm^2/s$) | | 6.7 | 3.5 | 3.5 | 6.7 |
| | | Tensile tenacity (kg/3 cm width) | Warp direction | 342 | 352 | 353 | 342 |
| | | | Weft direction | 359 | 366 | 364 | 359 |
| Characteristics of layered products | No. 1 | Basis weight ($g/m^2$) | | 3360 | 3300 | 3348 | 3360 |
| | | Bulletproofness [V50FSP]: | | | | | |
| | | Bullet speed (m/s) | | 505 | 519 | 528 | 505 |
| | | Impact energy ($J \cdot m^2/kg$) | | 41.7 | 44.9 | 45.8 | 41.7 |
| | No. 2 | Basis weight ($g/m^2$) | | — | — | — | 9760* |
| | | Bulletproofness [bullet penetrability]: | | — | — | — | 0 |
| | | Number of penetrated bullets | | — | — | — | 6 |
| | | Number of unpenetrated bullets | | | | | |

*Fabric 84.0 $g/m^2$ × 40 layers + shield material 160.0 $g/m^2$ × 40 layers = layered product 9760 $g/m^2$.

TABLE 7

| | | | Comparative Example 1 | Comparative Example 2 | Comparative Example 3 | Comparative Example 4 | Comparative Example 5 | Comparative Example 6 |
|---|---|---|---|---|---|---|---|---|
| Characteristics of fabrics* | Basis weight ($g/m^2$) | | 84.0 | 72.6 | 96.0 | 84.0 | 174.4 | 160 |
| | Air permeability ($cc/cm^2/s$) | | 6.5 | 38.5 | 51.5 | 49.2 | 0.4 | 0 |
| | Tensile tenacity (kg/3 cm width) | Warp direction | 157 | 298 | 351 | 290 | 501 | 310 |
| | | Weft direction | 159 | 302 | 356 | 311 | 513 | 300 |
| Characteristics of layered products | No. 1 | Basis weight ($g/m^2$) | 3360 | 2904 | 3840 | 3360 | — | — |
| | | Bulletproofness [V50FSP]: | | | | | | |
| | | Bullet speed (m/s) | 300 | 449 | 497 | 446 | — | — |
| | | Impact energy ($J \cdot m^2/kg$) | 14.7 | 38.2 | 35.4 | 32.6 | — | — |
| | No. 3 | Basis weight ($g/m^2$) | — | — | — | — | 4709 | — |
| | | Bulletproofness [V50FSP]: | | | | | | |
| | | Bullet speed (m/s) | — | — | — | — | 487 | — |
| | | Impact energy ($J \cdot m^2/kg$) | — | — | — | — | 27.7 | — |
| | No. 4 | Basis weight ($g/m^2$) | — | — | — | — | 11109 | — |
| | | Bulletproofness [bullet penetrability]: | | | | | | |
| | | Number of penetrated bullets | — | — | — | — | 6 | — |
| | | Number of unpenetrated bullets | — | — | — | — | 0 | — |
| | No. 5 | Basis weight ($g/m^2$) | — | — | — | — | — | 10880 |
| | | Bulletproofness [bullet penetrability]: | | | | | | |
| | | Number of penetrated bullets | — | — | — | — | — | 0 |
| | | Number of unpenetrated bullets | — | — | — | — | — | 6 |

*For Comparative Example 6, the characteristics as a shield material are shown.

As can be seen from Tables 6 and 7, the bulletproof fabrics of Examples 1 to 4, although they are light fabrics with small basis weight, exhibited high tensile tenacity and excellent bulletproof performance. In contrast, the bulletproof fabrics of Comparative Examples 1, 2 and 4, although they were produced with a UHMW-PE fiber that was the same material as used in Examples 1 to 4, exhibited low tensile tenacity and poor bulletproofness. The bulletproof fabric of Comparative Example 5, although it exhibited high tensile tenacity and excellent bulletproofness, were heavy fabrics with large basis weight.

As can be seen from the comparison between layered product No. 5, which contains only 68 layers of the shield material of Comparative Example 6, and layered product No. 2, which contains 40 layers of the bulletproof fabric of Example 4 and 40 layers of the shield material of Comparative Example 6, if the bulletproof fabric of the present invention is used in layers with the shield material of conventional example 2.1, the resulting layered product is about 10% reduced in weight, while exhibiting similar bulletproof performance.

In the bulletproof fabric of the present invention, the material performance of filaments used can be fully utilized to exhibit high bulletproof performance. In addition, the bulletproof fabric of the present invention has such excellent bulletproofness, so that there is no need to produce a thick fabric, resulting in a lightweight bulletproof fabric. In the meantime, the bulletproof performance can cope not only with the threats of high level but also with the threats of relatively low level.

The bulletproof fabric of the present invention can also be used in combination with other materials such as metal plates, ceramics materials or shield materials. That is, the bulletproof fabric of the present invention can be used in this manner as a supplementary material to various protective materials, thereby making a great contribution to the weight reduction and bulletproofness improvement of the protective materials.

We claim:

1. A bulletproof fabric comprising a non-twisted, non-interlaced multifilament having a total fineness of 10 to 1000 denier both as a warp and as a weft, the multifilament consisting mainly of a high-strength, high-modulus filament having a single fiber fineness of 10 denier or less, wherein the value of $\alpha$ calculated by expression (1):

$$\alpha = N \cdot D/1000 \quad (1)$$

where N is the density in warp of fabric (yarns/inch) and D is the total fineness (d), is in the range of from 8.5 to 10.5, and the air permeability of the fabric satisfies expression (2):

$$P \leqq \alpha^2/[7+D^{(1/2N)}] \quad (2)$$

where P is the air permeability ($cc/cm^2/s$) as defined in JIS L 1079 5-20.

2. The bulletproof fabric according to claim 1, wherein the multifilament comprises a filament having a tensile strength of 20 g/d or more, an elongation at break of 6% or less, and an initial tensile modulus of 400 g/d or more.

3. A process for producing a bulletproof fabric as set forth in claim 1, which comprises:

preparing a non-twisted, non-interlaced multifilament by opening original filaments so that a bundle of the filaments has a flat section;

applying a fabric size to the multifilament, followed by drying; and weaving the sized multifilament as a warp or both as a warp and as a weft into the fabric.

4. The process according to claim 3, wherein the fabric size is applied in an amount of 4wt % or more to the multifilament.

5. The process according to claim 3, further comprising scouring 60 wt % or more of the applied fabric size from the fabric after the weaving.

6. The process according to claim 5, further comprising subjecting the fabric after the scouring to calendar press treatment so that the fabric-forming multifilament has increased linearity.

7. The process according to claim 5, further comprising coating the fabric after the scouring with an agent for reducing the frictional resistance of the fabric.

* * * * *